United States Patent [19]

Kelly

[11] 4,307,883

[45] * Dec. 29, 1981

[54] TWO-STAGE PANEL BOWLING LANE SURFACE

[75] Inventor: Peter B. Kelly, Pasadena, Tex.

[73] Assignee: General Electric Company, Coshocton, Ohio

[ * ] Notice: The portion of the term of this patent subsequent to Nov. 4, 1997, has been disclaimed.

[21] Appl. No.: 59,216

[22] Filed: Jul. 20, 1979

Related U.S. Application Data

[60] Continuation-in-part of Ser. No. 926,604, Jul. 21, 1978, which is a division of Ser. No. 901,791, May 1, 1978, abandoned, which is a continuation of Ser. No. 506,069, Sep. 16, 1974, abandoned.

[51] Int. Cl.[3] ..... A63D 1/04; B32B 5/26; B32B 5/30; B32B 21/08; B32B 27/42; B32B 31/20

[52] U.S. Cl. ..... 273/51; 156/61; 156/307.3; 156/307.4; 428/204; 428/207; 428/211; 428/528; 428/530; 428/535; 428/537

[58] Field of Search ..... 156/61, 309; 273/51; 428/204, 207, 211, 528, 530, 535, 537

[56] References Cited

U.S. PATENT DOCUMENTS

| | | |
|---|---|---|
| 2,437,799 | 3/1948 | Yorke . |
| 2,531,168 | 11/1950 | Snyder . |
| 2,605,205 | 7/1952 | Patterson . |
| 2,816,851 | 12/1957 | Ardledter . |
| 2,928,456 | 3/1960 | Potchen et al. . |
| 3,135,643 | 6/1964 | Michl . |
| 3,373,070 | 3/1968 | Fuerst . |
| 3,373,071 | 3/1968 | Fuerst . |
| 3,663,341 | 5/1972 | Venezeale . |

*Primary Examiner*—James C. Cannon

*Attorney, Agent, or Firm*—Morgan, Finnegan, Pine, Foley & Lee

[57] ABSTRACT

A two stage panel suitable as a bowling lane comprising a decorative laminate sheet bonded in situ to a substrate selected from the group consisting of natural wood, consolidated wood fibers, plywood, flakeboard, chipboard and hardwood. The plastic laminate sheet comprises a plurality of thermosetting resin impregnated core sheets, a melamine resin impregnated decorative fibrous print sheet and an overlying melamine resin containing protective layer. The surface of the bowling lane so produced is characterized by a falling ball impact resistance of at least 60 inches, a coefficient of friction of at least about 0.16 and a Taber abrasion resistance at least about 500 cycles.

7 Claims, No Drawings

TWO-STAGE PANEL BOWLING LANE SURFACE

RELATED APPLICATIONS

This application is a continuation-in-part of my U.S. Patent Application Ser. No. 926,604, filed July 21, 1978 which is a division of my U.S. Patent Application Ser. No. 901,791, filed May 1, 1978, now abandoned, which is a continuation of my U.S. Patent Application Ser. No. 506,069, filed Sept. 16, 1974, now abandoned.

BACKGROUND OF THE INVENTION

1. Field of Invention

This invention relates to new and improved panels for bowling lane structures. More particularly, it relates to new and improved two-stage panels which provide bowling lane surfaces.

2. Description of the Prior Art

Standard bowling lanes are often constructed of suitably finished hardwood blocks or planking. In such a lane bed, usually about 41 to 42 inches wide, the construction typically consists of from about 39 to 42 maple planks or boards about one inch thick laid edgewide in line with the longitudinal axis of the lane. The surface of the lane is made flat and coated with varnish or lacquer which is then treated as with mineral oil to reduce wear and adjust the coefficient of friction or slippage of the surface in order to produce uniform action and control of the bowling ball. The surface finish consists typically of a nitrocellulose or polyurethane lacquer which can be treated with plasticizers and other additives to provide with the oil treatment the desired wear and slippage or friction characteristic.

While wooden lanes have been in use for many years, they are subject to a number of deficiencies. For example, present wooden lanes can be easily and severely damaged in the areas of ball release and at the pin deck. Such damage in the ball release area is intensified by lofting of the ball which, upon impact, dents the lacquered and oiled wooden surface. Even normal releases of the ball damage the lane although to a lesser degree. Surface damage in the pin deck area is primarily caused by contact of the struck pins with the surface. Under ordinary circumstances, standard bowling lanes are inspected and often sanded and refinished on an annual basis. Such refinishing is necessary in order to meet set bowling standards and in order to provide uniformity of all lanes so that comparable performance and scoring can be attained insofar as these factors are controlled by the physical condition of the bowling lane itself as opposed to the skill of the bowler.

Materials other than wood have been suggested for use in bowling lanes. For example, U.S. Pat. No. 2,531,168 teaches a top surface layer for bowling alleys formed of laminated plastic compounds such as phenolic, vinyl, acrylic, cellulose acetate, etc. And U.S. Pat. No. 3,014,722 discloses bowling alley lanes formed of sections of laminated fibrous sheet material plies. Other materials have also been disclosed in U.S. Pat. No. 3,670,049 (a moisture curable polyurethane coating composition suitable for finishing bowling lanes); U.S. Pat. No. 3,670,060 (metal bowling alley lanes); U.S. Pat. No. Re. 25,496 (granite as a material for fabricating bowling alley lanes); U.S. Pat. No. 2,679,396 (hard rubber as a bowling alley lane material; and U.S. Pat. No. 2,193,468 (grass like carpet useful in covering a game alley. None of these wood substitutes have proven to be commercially acceptable and wood lanes predominantly remain the materials in common usage today.

U.S. Pat. No. 2,437,799 discloses a laminating varnish (thermosetting resin dissolved in solvent) which incorporates finely comminuted glass fibers of critical dimensions; the thermosetting resin may be melamine, phenolic. A core material is impregnated with a thermosetting synthetic resin varnish. U.S. Pat. No. 2,928,456 discloses prehardened and prefabricated glass fiber reinforced polyester sheets which are bonded to foamed polystyrene cores (density of about 2 lbs/ft$^3$). And U.S. Pat. No. 3,663,341 discloses a three sheet overlay comprised of a protective overlay glass fiber containing sheet, a decorative Kraft paper containing sheet and a shock-absorbing sheet. The core may be Kraft paper saturated with phenolic resins. The three sheet panel can be bonded or glued to plywood, gypsum board, lumber, particle board, etc. The substrate is preferably flakeboard having a density of greater than 46 lbs/ft$^3$.

Japanese application No. SHO-50-111020 laid open for inspection on May 18, 1976 as Publication No. SHO-51-56548, corresponds to U.S. patent application Ser. No. 506,069, filed Sept. 16, 1974, now abandoned, (the disclosure of which was carried forward in U.S. patent application Ser. No. 926,604, filed July 21, 1978 [hereinafter the '604 application]) and discloses a high pressure laminate surface suitable for bowling alley lanes. These bowling lane surfaces have been successfully tested in the United States and been welcomed as an advance in the art. See e.g., *Bowling* January, 1977 at page 6.

SUMMARY OF THE INVENTION

1. Objects of the Invention

It will be seen from the above that there is a need for bowling lanes and surfaces, therefore, which are more resistant to physical abuse and wear, have uniformity of surface and which can maintain these qualities over a long period of time.

The bowling lane and surface described in the '604 application, assigned to the same assignee as this application, responds, in part, to this need. Therein, there are disclosed particular decorative plastic laminates used to provide improved bowling lanes and surfaces therefor. Each bowling lane comprises a substrate selected from the group consisting of natural wood, consolidated wood fibers, plywood, flakeboard, chipboard and hardboard, and at least one decorative plastic laminate sheet secured to the surface of the substrate. The plastic laminate sheet comprises a plurality of thermosetting resin impregnated core sheets, a melamine resin impregnated decorative fibrous print sheet and an overlying melamine resin containing protective layer. The surface of the bowling lane so produced is characterized by a falling ball impact resistance of at least 60 inches, a coefficient of friction of about 0.18 and a Taber abrasion resistance of at least about 500 cycles.

For resurfacing operations, the laminate of the '604 application may be simply glued over existing pine and maple bowling lanes. For new applications, the laminate of '604 application may be glued to a suitable substrate such as wood, metal, concrete and the like. As previously indicated herein, the bowling lane and surface disclosed in the '604 application has made for a significant advance in the art. The present invention is considered to be an improvement on the invention of the '604 application and its main features and objectives are thus similar to those of the '604 application.

It has been found that when the substrate of the bowling lane is comprised of wood or a similar cellulosic core material, the intermediate step of first making a laminate and then converting to a panel by glueing the laminate to a suitable substrate may be eliminated. Eliminating this step not only is economical but provides a two-stage panel which is comparable in all respects to the three-stage panel previously disclosed, i.e., the surface-adhesive-core stages panel.

The two-stage panel comprises (a) an outer surface stage, a print surface such as paper impregnated with a material which acts as both surface and adhesive and is activated under heat and pressure, and (b) a substrate stage, a cellulosic type material. The outer surface stage may, for example, comprise a low pressure melamine panel, a low pressure polyester panel or the like. Suitable materials for the substrate stage are selected from the group consisting of the substrate materials of the '604 application, the disclosure of which is incorporated herein by reference.

It is, therefore, a primary objective of this invention to provide bowling lanes and surfaces for bowling lanes which comprise a two-stage panel composed of laminate bonded in situ to a cellulosic type substrate.

Another object is to provide a single stage panel suitable for use as a bowling lane.

Still another object is to provide a one or two-stage panel for use as a bowling lane which panel provides an outer surface superior to that of standard wooden lanes.

An object of this invention is to provide a bowling lane having longer wear than wooden lanes or lanes of the '604 application.

These and other objects will readily become apparent to those skilled in the art in the light of the teachings hereinafter set forth.

2. Brief Summary of the Invention

Briefly, according to the present invention, there is provided a one or two stage panel having a decorative laminate bonded in situ to a cellulosic type substrate. The plastic laminate and cellulosic type substrate are described in the '604 application, the disclosure of which is incorporated herein by reference.

DESCRIPTION OF THE PREFERRED EMBODIMENTS

It has been found that the separate step of applying an adhesive between the laminate and the substrate in the '604 application may be eliminated by incorporating an adhesive/surface material into the surface layer of the laminate which interfaces with the substrate of the laminate. When the laminate is formed under heat and pressure, the laminate is simultaneously bonded in situ to the substrate.

When two laminates are bonded in situ to opposite outer faces of a substrate sheet, the "two-stage" panel may be installed in a bowling alley as a bowling lane and flipped over when one of the decorative laminate surfaces begins to deteriorate to such an extent that play on the lane is affected. The two-stage surface laminate of this invention preferably has substantially the same thickness as the laminate of the '604 application. The thickness of the center board in these panels is limited only by the necessity of withstanding impact without rupturing. However, because of the current construction of bowling lanes, gutters, etc., and the American Bowling Congress specifications for the same, the finished panels are preferably the same thickness as existing wooden lanes. Two-faced, "two-panel" bowling lanes not only provide perfect balance, but also provide minimal warp and two wear surfaces. When one surface is worn to the point where it is no longer aesthetically acceptable, the panel may then simply be reversed to provide a new wear surface.

Single stage panels are also within the scope of this invention. The substrate should be hard and dense enough to withstand in-service impacts of bowling balls and/or pins, and the wear surface must be tough enough to withstand the abrasion to which it is subjected by bowlers.

The use of a dense substrate is critical for this invention. The panels should be made with at least 60 pound board as a substrate in order to withstand reasonable impact from a 16 lb. bowling ball. A 45 lb. board has been found to be inadequate. With a 45 lb. board as a substrate, the decorative laminate surface ruptured when impacted with a 16 lb. bowling ball and the board crushed beneath the impact of the ball.

In addition to the above-mentioned properties, it has been found that the bowling lane surfaces in accordance with the present invention are comparable in other respects to the bowling lane surfaces of the '604 application and have a NEMA Standard 8-19-64 fall ball impact resistance of over 60 inches as compared to 32 inches for a typical varnished or lacquered hardwood lane. When a 16 pound standard bowling ball is dropped on the bowling lane of this invention from a height of 3 feet, there is no effect. Both with polyurethane varnish and the nitrocellulose lacquer treated wooden bowling lanes, a deep surface dent resulted from such treatment and the wood fibers of the surface were torn. As measured by the Taber abraser, the NEMA Standard 8-20-1962 abrasion resistance of the lane described in the '604 application is from about 500 cycles to 2500 cycles depending on the particular surface, whereas the polyurethane varnish and nitrocellulose lacquer finished lanes have a Taber abrasion resistance of 40 cycles and 25 cycles respectively. The resistance of the surfaces described in the '604 application to a burning cigarette in accordance with NEMA Standard 8-19-64 is 300 seconds as opposed to 90 seconds to charring for the polyurethane varnish and 24 seconds to burning with the nitrocellulose lacquer. The slip or coefficient of friction of the surface described in the '604 application is 0.18 as compared to 0.18 for typical polyurethane varnished layers and 0.16 for typical nitrocellulose lacquer coated lanes, all measurements being taken with an oil-treated surface. The surfaces of the '604 application are furthermore resistant to staining by alcohol, detergent, shoe polish, and mustard whereas polyurethane varnished surface lanes are stained by mustard, and nitrocellulose lacquer surface lanes are stained by alcohol, shoe polish and mustard. The 60 degree gloss of the lanes described in the '253 application is also comparable to those of present hardwood lanes surfaced with nitrocellulose lacquer.

Any of a number of substrates can be used in connection with the surface of the present invention including natural wood such as maple planks and consolidated wood fibers, plywood, flakeboard, chipboard and hardboard.

The bowling lane surfaces or laminates of the present invention are readily made. The core is comprised of a suitable high density (greater than 60 pounds) cellulosic material including but not limited to hardboard, pressboard, chipboard or other cellulosic composites and plywood. The core may be optionally surrounded with one or more contiguous crepe paper sheets impregnated with one of the thermosetting resins conventionally used in the production of decorative laminates. The most common of these resins is an alkaline catalyzed condensation product of a phenol and an aldehyde. A specific phenolic resin used in this connection is a light colored, thermosetting, general purpose phenol formaldehyde resin of the above description sold by the Monsanto Company under the name of Resinox 470. Alternatively, tfhe core may optionally be surrounded with one or more contiguous glass sheets impregnated with an epoxy resin formed by the coreaction of trimellitic anhydride and the diglycidyl ether of bisphenol A.

As in typical decorative laminates, the core of cellulosic material surrounded by creped kraft paper or epoxy glass sheets are overlaid with a so-called print sheet which imparts the decorative effect as of a wooden grain or other appearance to the laminate. The print sheet can be impregnated as is usual in ordinary decorative laminates. It has been found that a lesser amount than usual of the thermosetting resin impregnant is desirable in the print sheet to toughen the surface of the laminate and make it more impact and fracture resistance in order to resist growing and denting of the surface. Any of a number of thermosetting resins can be used in the formulation for the impregnant used for impregnating the print sheet where this is indicated including, preferably, a condensation product of melamine and an aldehyde, such materials being characterized by excellent wearing, translucency and resistance to discoloring. A specific material found useful in this connection is a modified melamine formaldehyde reaction product sold by American Cynamid Company under the name of Cymel 428. This resin is a white, free-flowing powder specifically designed for the treatment of paper to be used in decorative laminates. The resin is readily soluble in water or in alcohol-water solvents and gives a clear, colorless solution which is stable at 50 percent by weight solids content for at least two days at room temperature. Typical properties of a 50 percent aqueous solution of this resin at 25° C. include a pH of 8.8 to 9.6, a Gardner viscosity of A to B, a solids content at maximum dilution in water of 26 percent. However, other resins, such as ureas, aminotriazines, light highly purified phenolic resins, polyester resins including unsaturated alkyl-vinyl monomer types, acrylics, ethoxyline resins and the like can also be used. Among the melamine resins which can be used are the several more fully described in U.S. Pat. No. 2,605,205.

Where a paper overlay or protective layer is used, it is normally a highly purified, transparent, alpha cellulose although it can also consist of other transparent or highly translucent cellulosic or synthetic resin fibers such as those of rayon or mixtures of such fibers such as those described in U.S. Pat. No. 2,8716,851, among others. This material is impregnated with a self-bonding adhesive containing material such as the melamine resin described previously herein and usually dried to a resin content of from about 33 to 42 percent by weight before consolidation.

If desired, the abrasion and wear resistance of the paper layer can be increased by incorporating abrasive materials such as finely divided silica, silicon carbide, emery, diamond, tungsten carbide, titanium carbide, boron nitride, aluminum oxide and mixtures of such materials with each other and with other finely divided materials, the wear or abrasion resistance of the overlay being specifically tailored as desired by using materials of the desired hardness. These materials can be uniformly distributed throughout the overlay as by the teaching of U.S. Pat. No. 3,373,070, to give uniform abrasion resistance as the overlay is worn away or they can be concentrated in the surface of the overlay or graded through the thickness of the overlay as desired.

The following example illustrates the practice of the present invention, it being realized that it is to be taken as exemplary only and not as limiting in any way.

EXAMPLE

This example illustrates a bowling lane having a decorative laminate surface incorporating a thermosetting resin containing material for impregnating a paper overlay. There was prepared an overlay of alpha cellulose paper impregnated with a 50 percent water solution of melamine formaldehyde resin, specifically Cymel 428, the impregnated paper being dried to a resin content of 65 percent by weight. There was also prepared in a similar manner a core layer of 60 pound density plywood and 140 pound basis weight creped kraft paper which were impregnated with a 50 percent solution of standard alkaline catalyzed phenol-formaldehyde resin, the dried resin content of each such core layer being about 30 percent by weight. The laminate was prepared by successively superimposing a melamine impregnated overlay paper as described above, one 55 pound basis weight raw or unimpregnated print sheet, one phenolic resin impregnated creped kraft paper sheet, one 60 pound density plywood sheet, phenolic resin impregnated creped kraft paper sheets, one 55 pound basis weight raw or unimpregnated print sheet and a melamine resin impregnated overlay paper as described above. The laminate so laid up was placed between polished stainless steel panels, cured for 15 to 18 minutes at 130° to 135° C. at 1500 psi, the laminate then being cooled still under pressure to below 40° C. and removed from the press. Actually, the laminating process is of a time-temperature-pressure nature and can be prepared by curing for from about 20 to 25 minutes at from about 130° C. to 150° C. at pressures ranging from about 1000 psi to about 1500 psi. The resulting laminate was 130 mils thick. The less adhesive-thermosetting resin material present in the print, the tougher the surface and the more impact and fracture resistant it is. Thus, in this example, a raw or unimpregnated print layer was used so that it could be impregnated but not excessively by reason of adhesive-thermosetting resin migration from the adhesive-thermosetting resin impregnated overlay paper. The finished laminate was cured to size and cemented using contact cement to an existing hardwood bowling lane. Joints between laminate sheets were filled with elastomeric material, specifically RTV silicone calk. Other useful calks are well known polyurethane and polysulfide materials.

The following table shows the results of various tests performed on bowling lanes surfaced with the material of the Example as compared with standard bowling lanes finished respectively with polyurethane varnish and nitrocellulose lacquer, all tests being carried out in accordance with NEMA publication LD 1-1964.

| National Electircal Manufacturers Association Standard Tests (NEMA Pub. No. LD 1-64) | | | |
|---|---|---|---|
| Test | Example 1 | Polyurethane Varnish** | Nitrocellulose Lacquer** |
| Impact, falling ball | 60 inches | 32 inches | 30 inches |
| Impact, * 16 pound bowling ball, 3 feet | No effect | Deep dent, torn wood fibers | Deep dent, torn wood fibers |
| Abrasion Resistance (Taber) | 500 cycles | 40 cycles | 25 cycles |
| Cigarette Resistance | 300 second | 90 seconds (charred) | 24 seconds (on fire) |
| Staining | | | |
| Alcohol | No | No | Yes |
| Detergent | No | No | No |
| Shoe Polish | No | No | Yes |
| Mustard | No | Yes | Yes |

*Improvised test using standard hardwood lane above **or with surfaces of invention.

From the above it will be seen that the bowling lanes of the present invention surfaced with the present decorative laminate surfacing materials are far and away superior to present bowling lanes or alley surfaces from the point of view of impact and abrasion resistance. At the same times, the present surfaces match or very closely approximate the coefficient of friction of present surfaces so that slippage and control of the ball on the mineral oil dressed lane is not changed. This is borne out by the experience of bowlers using the new lanes.

What I claim as new and desire to secure by Letters Patent of the United States is:

1. A bowling lane having a surface characterized by a falling ball impact resistance of at least 60 inches, a co-efficient of friction of at least 0.16 and a Taber abrasion resistance of at least about 500 cycles, said bowling lane comprised of at least one decorative plastic laminate which has been adhered to a substrate under conditions of heat and pressure, said laminate comprised of at least one thermosetting resin impregnated fibrous sheet underlying a melamine impregnated decorative fibrous print sheet and an overlying melamine resin containing protective layer, said substrate comprised of a cellulosic board of at least 60 pounds selected from the group consisting of natural wood, consolidated wood fibers, plywood, flakewood, chipboard and hardboard.

2. A bowling lane as defined in claim 1 wherein said fibrous print sheet is creped Kraft paper.

3. A bowling lane as defined in claim 1 wherein said thermosetting resin impregnated fibrous sheet is a phenolic resin impregnated creped paper sheet.

4. A bowling lane as defined in claim 1 wherein the overlying protective layer is a fibrous sheet impregnated with a melamine resin.

5. A bowling lane as defined in claim 1 wherein said overlying protective layer has abrasion resistant material incorporated therein.

6. A method of producing a bowling lane having a surface characterized by a falling ball impact resistance of at least 60 inches, a coefficient of friction of about 0.16 and a Taber abrasion resistance of at least 500 cycles comprising: providing a substrate comprised of a cellulosic board of at least 60 pounds, said board selected from the group consisting of natural wood, consolidated wood fibers, plywood, flakeboard, chipboard and hardwood superimposing at least one thermosetting resin impregnated fibrous sheet over said substrate board in registration therewith;

superimposing at least one thermosetting resin impregnated decorative fibrous print sheet over and in registration with said at least one thermosetting resin impregnated print sheet;

superimposing at least one overlying thermosetting resin containing protective layer over said thermosetting resin impregnated decorative fibrous print sheet in registration therewith;

consolidating said substrate, at least one thermosetting resin impregnated fibrous sheet, at least one thermosetting resin impregnated decorative fibrous print sheet and at least one resin containing protective layers under heat and pressure to produce a unitary decorative plastic laminate panel.

7. A method as defined in claim 6 further including the steps of:

providing at least one thermosetting resin impregnated decorative fibrous sheet under said core board in registration therewith;

providing at least one overlying thermosetting resin containing protective layer under said resin impregnated decorative fibrous print sheet in registration therewith.

* * * * *